US007188727B2

(12) United States Patent
Chamier von Gliszczynski

(10) Patent No.: US 7,188,727 B2
(45) Date of Patent: Mar. 13, 2007

(54) PACKAGING MADE OF FLAT BLANKS

(76) Inventor: Hartwig Chamier von Gliszczynski, Am Wasserfeld 8, Fintel (DE) D-27389

( * ) Notice: Subject to any disclaimer, the term of this patent is extended or adjusted under 35 U.S.C. 154(b) by 434 days.

(21) Appl. No.: 10/487,855

(22) PCT Filed: Aug. 30, 2002

(86) PCT No.: PCT/DE02/03210

§ 371 (c)(1),
(2), (4) Date: Feb. 26, 2004

(87) PCT Pub. No.: WO03/024841

PCT Pub. Date: Mar. 27, 2003

(65) Prior Publication Data

US 2004/0245143 A1 Dec. 9, 2004

(30) Foreign Application Priority Data

Aug. 31, 2001 (DE) ..... 201 14 285 U

(51) Int. Cl.
*B65D 85/30* (2006.01)

(52) U.S. Cl. ..... 206/521.8; 206/521.1; 493/90; 493/138

(58) Field of Classification Search ..... 206/521.1, 206/521.3, 521.4, 521.8, 521.9; 229/120.24, 229/120.38; 493/84, 90, 91, 138
See application file for complete search history.

(56) References Cited

U.S. PATENT DOCUMENTS 2,261,625 A * 11/1941 Jones ..... 493/55
3,248,036 A 4/1966 Weiss
3,473,295 A 10/1969 Nigrelli et al.
3,889,580 A 6/1975 Garst
4,154,148 A 5/1979 Weremiczyk et al.
4,320,866 A * 3/1982 Gardner ..... 229/800
4,462,537 A 7/1984 Grootherder et al.
4,621,484 A 11/1986 Casutt
4,884,740 A 12/1989 Ross
4,934,533 A 6/1990 Roila
5,379,945 A * 1/1995 Kataoka ..... 229/120.26

FOREIGN PATENT DOCUMENTS

| | | |
|---|---|---|
| DE | 32 33 511 A1 | 3/1983 |
| FR | 1 355 546 A | 10/1962 |
| FR | 2 491 874 A | 6/1980 |
| GB | 1 212 431 | 11/1970 |
| NL | 9 102 002 | 11/1991 |
| WO | WO 96/38355 | 12/1996 |
| WO | WO 98/43897 | 10/1998 |
| WO | WO 00/76882 A1 | 12/2000 |

* cited by examiner

*Primary Examiner*—David T. Fidei
(74) *Attorney, Agent, or Firm*—Hedman & Costigan, P.C.

(57) ABSTRACT

The object of this invention is a packaging comprising a cover, a bottom part with recesses and an insert for subdividing the bottom part into receptacle cells for holding round or egg-shaped packaged materials, manufactured from essentially flat blanks and a method of uprighting the insert.

26 Claims, 3 Drawing Sheets

PACKAGING MADE OF FLAT BLANKS

This invention relates to a packaging that is manufactured essentially from flat blanks consisting of a cover, a bottom part with recesses and an insert that is folded up for subdividing the bottom part into receptacle cells to accommodate round or egg-shaped materials for packaging; this invention also relates to a method of assembling the insert.

Traditional packagings for eggs usually consist of molded cardboard or plastic manufactured that have a defined shape and are supplied as stacked units consisting of a plurality of identical packages.

This type of packaging has the disadvantage that it is relatively bulky even when stacked and therefore causes considerably higher shipping costs due to the poor utilization of volume.

In addition, the packages have surfaces which are do not accept printing well or at all because of their rough porous surface and yield only a poor quality which is not very attractive. Therefore, it has become customary to apply printed labels for he user information. However, application of such labels is less advantageous for cost reasons due to the price of the label and the additional adhesive step required.

Another disadvantage of packaging made of molded cardboard is the unfavorable price of the material (in comparison with corrugated cardboard—and the high sensitivity of the molded cardboard to moisture. For example, even atmospheric moisture has a greater influence on the surface extent of the material than is the case with corrugated cardboard. Constant dimensions of the packaging units are essential for machine processability. Although most egg packaging machines allow relatively high tolerances, excessive fluctuations nevertheless result in errors in the production process.

In Germany, far more than 100 million egg containers are manufactured and sold each year. Differences in the manufacturing price per package including printing and/or labeling, thus ensure a retail advantage which is not to be underestimated in view of the total number of items involved.

Since six-egg and ten-egg packaging made of molded cardboard has become the quasi-standard for egg packaging in Germany, it is important for any new packaging that is developed to be usable on traditional egg packaging machines without requiring any modification thereof. In particular, it is advantageous if the newly developed packaging and the traditional molded cardboard packaging can be used one after the other on the same machine without requiring any adjustments or changes in the settings of the machines.

WO 98/43897 and U.S. Pat. No. 4,934,533 disclose packagings which can be manufactured from flat corrugated cardboard by folding and gluing. However, these packages cannot be stacked after they have been opened and therefore cannot be used in traditional packaging machines. In particular the package according to U.S. Pat. No. 4,934,533 has inadequate stability when closed, which thus prevents reliable stacking of filled packages.

U.S. Pat. No. 4,462,537 discloses an egg carton in which the top and bottom parts are made of flat cardboard and which have an insert made of plastic or molded cardboard to accommodate the material for packaging, whereby the bottom part has recesses which are used to accommodate the upright elements of the plastic or molded cardboard insert of the lower box which is stacked beneath an upper box.

According to another embodiment of U.S. Pat. No. 4,462,537, the side walls have recesses and the webs which subdivide the bottom part of the package into receptacle cells are either formed by a plurality of individual pyramid-shaped elements arranged on the bottom surface or by folds aligned in parallel with the longitudinal side of the packaging. Such a package then has the disadvantage that when opened, it cannot be stacked at all or cannot be stacked well and it is more experience to manufacture.

WO 00/76882-A1 describes a package manufactured of flat blanks and comprising a cover, a bottom part and webs that protrude upward for subdividing the bottom part into individual receptacle cells. The webs have upper and lower folded edges that are aligned to be parallel with the narrow side wall of the package. The bottom part is characterized by recesses to accommodate the webs of a similar second opened package stacked beneath the opened package. The recesses in the bottom part are not covered by the webs, however, so that packaging is open toward the bottom and in the case of use as an egg carton, liquid can escape from the eggs and run out when there is occasional breakage of eggs.

The object of this invention is to overcome the disadvantages of the state of the art as described above and to provide an inexpensive packaging that can be processed on a machine. For packaging that can be processed on a machine, the packaging must be stackable such that the stacks serve as a supply for the packaging machines on the input side, can be sorted and thus can be separated by machine.

This invention is characterized by a packaging comprising a cover, one or more inserts and a bottom part, whereby

- the cover and bottom part are manufactured from one or more flat blanks,
- the insert divides the bottom part into receptacle cells,
- the insert of a flat laying blank along an upper fold line having at least one opening can be set upright with at least two, preferably at least three fold lines, extending from each of the openings to each of the two side edges that are aligned essentially in parallel with the upper fold line in the flat condition, to fold out side webs and central webs to form receptacle cells when the insert is set up, and
- the bottom part has one or more recesses to accommodate the insert of a similar second opened package stacked beneath the open first package.

The flat blanks are preferably made of cardboard and/or corrugated cardboard, especially preferably the covers and bottom part are made of corrugated cardboard and the insert is made of cardboard. Preferred embodiments are the object of the subclaims.

As a rule, the inventive packaging has one or more inserts having 2, 3, 4 or 5 passages, whereby one insert forms two rows, two inserts form three rows, etc., of receptacle cells with 3, 4, 5 or 6 receptacle cells per row.

In the case of two openings, two side webs are spanned by unfolding, with one receptacle cell within a row being bordered by two side webs of the insert, a middle web of the insert and a side wall of the package, while the two outer receptacle cells are each bordered by two side walls of the package, which are essentially at right angles to one another, and also by the middle web of the insert and one side wall of the insert.

The receptacle cells are designed to accommodate spherical or egg-shaped objects.

The insert is preferably designed so that the middle webs have a bent tongue on their lower ends at the side edges of the insert, said tongue being connectable to the bottom surface of the bottom part in the form of a supporting surface by gluing or pinching.

The insert is preferably designed so it can be turned upright from one piece of a flat blank.

The insert may extend from the bottom surface to the underside of the surface of the cover, with the upper folded edge and/or the cut edges of the upper openings of the insert coming in contact with the bottom side of the surface of the cover. This creates additional stability for stacking the filled packages. The insert preferably has cut lines along the upper middle folded edge which partially sever the folded edge—i.e., to approximately ⅕ to ½ of the length of the individual folded edge—to facilitate bending.

The bottom surface has one or more recesses to accommodate the inserts of a second similar package stacked beneath the opened package. The recess is situated in each case beneath the insert placed on the bottom surface.

The recess is preferably in the size and shape of the horizontal cut surface, i.e., aligned parallel to the bottom surface due to the insert which has been set upright at a height of less than ¼ the total height of the insert, preferably just above the bottom surface.

Preferably in the longitudinal direction, the recess has an essentially rectangular shape and in the area of the longitudinal side walls of the insert it has triangular or polygonal recesses extending to a pointed end in the direction of the longitudinal side wall of the package. The remaining inside bottom surface provides a hold for the underside of the insert. On both ends of the rectangular shape of the recess, which is essentially rectangular in the longitudinal direction, there are triangular tongues that can be advantageously directed upward and serve to close the insert at the transverse ends.

The insert is attached to the bottom surface, preferably by gluing tongues that are folded downward, preferably on the central webs of the insert.

The openings on the upper folding line of the insert in the simplest case are in the shape of a cut line in the flat lying state but may also be in the form of a diamond. The cutting points of the smaller angles of the legs forming the diamond lie on the upper folding line.

The folding lines which form the side web when unfolded span two adjacent folding lines and the longitudinal side edge of the insert, each preferably bordered by the cut lines of the opening, forming a trapezoidal area, whereby the lower leg of the trapezoid is longer than the opposite upper leg. The upper side web may also be unfolded in a non-angular pattern, e.g., in the form of a semicircle, and then it has only two of the outer folding lines which start from the upper opening.

It is also possible for the package objects to be protected by one or more soft flexible packaging materials such as crepe paper or foamed plastic film placed in the receptacle cells or optionally additionally glued in place there. Likewise a highly flexible plastic film may be stretched in place or a deep-drawn mold insert may be used. The plastic materials are preferably biodegradable.

The side walls are preferably designed in two or more parts, whereby the side walls are separated from one another by cut edges and/or folding edges. The packaging preferably has one lower side part and one upper side part—based on a side wall. According to another embodiment, the dividing line between the upper side part and the lower side part, preferably of each side part, is longer than the edge forming the side part and the bottom area and/or the side part and the cover area. In addition, the upper and lower side parts of one side wall advantageously have essentially the same heights. The lower side parts preferably do not have any recesses.

Of the side parts abutting against one another at an angle, preferably at least one has a tongue which, when the side walls are set upright, connects the side part to the side part of the other side wall which abuts against this one at an angle, preferably by gluing. The tongues are preferably designed in a triangular shape and have a folded edge with the side part to which they are connected in an articulated manner when lying flatly. The cover may have one or more recesses as in inspection openings. Recesses in the cover may be sealed with a transparent plastic film.

To simplify unfolding, it is advantageous to cut the folded edges, advantageously on the side opposite the acute angle, in particular for the folded edges of the insert, with the cut amounting to approximately half of the thickness of the material.

The cover and bottom part are joined together with an articulated joint, preferably by a folding edge in one of the side walls. The folding edge may be reinforced by applying adhesive, resulting in an additional recoil force enclosing the cover part.

Furthermore, the other opposite side part has one or more devices for closing the cover. The devices for closing the cover are preferably designed so on the one hand they have bulges and on the other hand have openings which serve to accommodate the bulges. One of the two parts of this holding device is mounted on one or more sealing tongues which, when the package is closed, grip beneath the side part of the bottom part or of the cover.

The bulges are advantageously created by cuts and then folding the cut edges outward. A spot of adhesive may be applied to the inside of the folded out part for stabilization.

Suitable materials for producing the flat blanks might include: cardboard blanks such as single layer or multilayer cardboard materials such as homogeneous cardboard, duplex cardboard or triple cardboard, or cardboard with a synthetic fiber or plastic fiber content. However, blanks made of composite materials or laminates or other flexible and foldable plastic materials are also suitable, and may include chemically modified natural raw materials such as cellulose. Corrugated cardboard or one of the materials listed above containing corrugated cardboard or corrugated layers is particularly suitable. It is important for the material to be bendable and foldable. All the materials listed above may optionally be coated, e.g., with polyethylene and should be suitable for printing. Printing may be performed, e.g., by letterpress printing, offset printing or gravure printing. The insert is preferably made of cardboard which is folded.

Suitable materials for packaging include fragile bulk materials such as eggs, chocolate products or fruit that would be sensitive to jarring or impact. The packages according to this invention have shown in practical tests that they are excellently suited for protecting fragile materials from the influence of compression and impact stresses.

The inventive packages may be stacked in an open condition in the magazines of egg packaging machines. These magazines usually remove the bottom carton from the stack, with the containers generally being gripped by needles puncturing them, rotating the containers and then guiding the opened container into a position to receive the eggs. Then the carton is closed by machine, whereby it is important that the closing tongue engages beneath the closing cover to make it possible to lock the bulges in the locking holes. The closing tongue is slightly raised for this reason when closing the cover.

At the same time the packages according to this invention have the advantage that they can be shipped in the form of flat blanks and can be set up just before use by a folding machine, optionally with the use of an adhesive such as hot glue.

The inventive packaging also has the advantage that it may be printed on all sides. For example, bar codes to be read by cash register scanners may be applied to advantage to the bottom side of the packaging. In addition, this invention makes it possible to produce the packaging from a few blanks, preferably only two blanks, namely one blank for the top and bottom part of the packaging and one blank for the insert.

In addition, the inventive packaging has the advantage that it can be stacked in a very small amount of space. Advantageously at least ⅔, preferably at least 70% of the height of an open packaging is taken up by the packaging unit stacked beneath it. At least 70, preferably at least 90 or especially preferably at least 110 opened packaging units can be stacked one above the other in a stack height of one meter. When using the inventive packaging for packaging eggs, approximately 120 boxes can be stacked in the opened state in one meter. The bottom part and cover here each have a height of approximately 3.5 cm.

To prevent the risk of injury, the cut edges may be roughened or designed with a zigzag edge, e.g., with small teeth.

According to another embodiment of this invention two or more packagings units may form one unit in which they are connected by webs to the side walls which may optionally be perforated for ease of separation. It is also possible here to construct the basic body of such a unit formed by two or more packaging units by using one blank. Such units are known for egg cartons by the term "double six carton" or "double ten carton."

In addition, the object of this invention also relates to a method of uprighting the insert described above and in the claims, in particular such inserts having at least n openings (where $n \geqq 2$) and n+2 tongues.

To do so, the flat blank of the insert is gripped by the tongues of the middle webs using displaceable holders, with each holder together with the respective tongue forming at least one holding point and with the holding points being moved in the direction of the center of the insert blank in a longitudinal movement (essentially parallel to the upper fold line of the insert) to fold out the side webs and being moved in a transverse movement (essentially perpendicular to the upper folding line of the insert) to fold out about the middle webs. All the holding points are in a holding point plane preferably during the longitudinal movement and the transverse movement. The longitudinal movement and transverse movement may take place simultaneously.

In addition, the unfolding of the side webs and the middle webs is preferably supported by uprighting devices, which are movable in the surface normal of the plane of the holding points and may be designed as lifting cylinders or gripping holders. During the longitudinal movement (preferably) and/or transverse movement, the uprighting devices act on the side web surfaces (preferably), preferably at the height of the middle folding lines of the side web there and/or act on the middle web surface, preferably at the height of the upper folding line, along a common direction with respect to the surface normals of the plane of the holding points.

The longitudinal movement and the transverse movement may take place simultaneously, but preferably the longitudinal movement takes place first with the transverse movement occurring separately from that.

The unfolded insert may be gripped by grippers, which may be designed as suction cup grippers, for example, preferably being gripped at the tongues on the middle webs and inserted into a carton bottom part where they are preferably anchored by gluing them to the bottom surface.

Each displaceable holder preferably includes a holding gripper and a movable counter-support so that the tongues of the middle webs are secured between the movable counter holder and the holding gripper during the longitudinal and transverse movements.

Advantageous embodiments of this invention are explained by the drawings.

Figure 1:
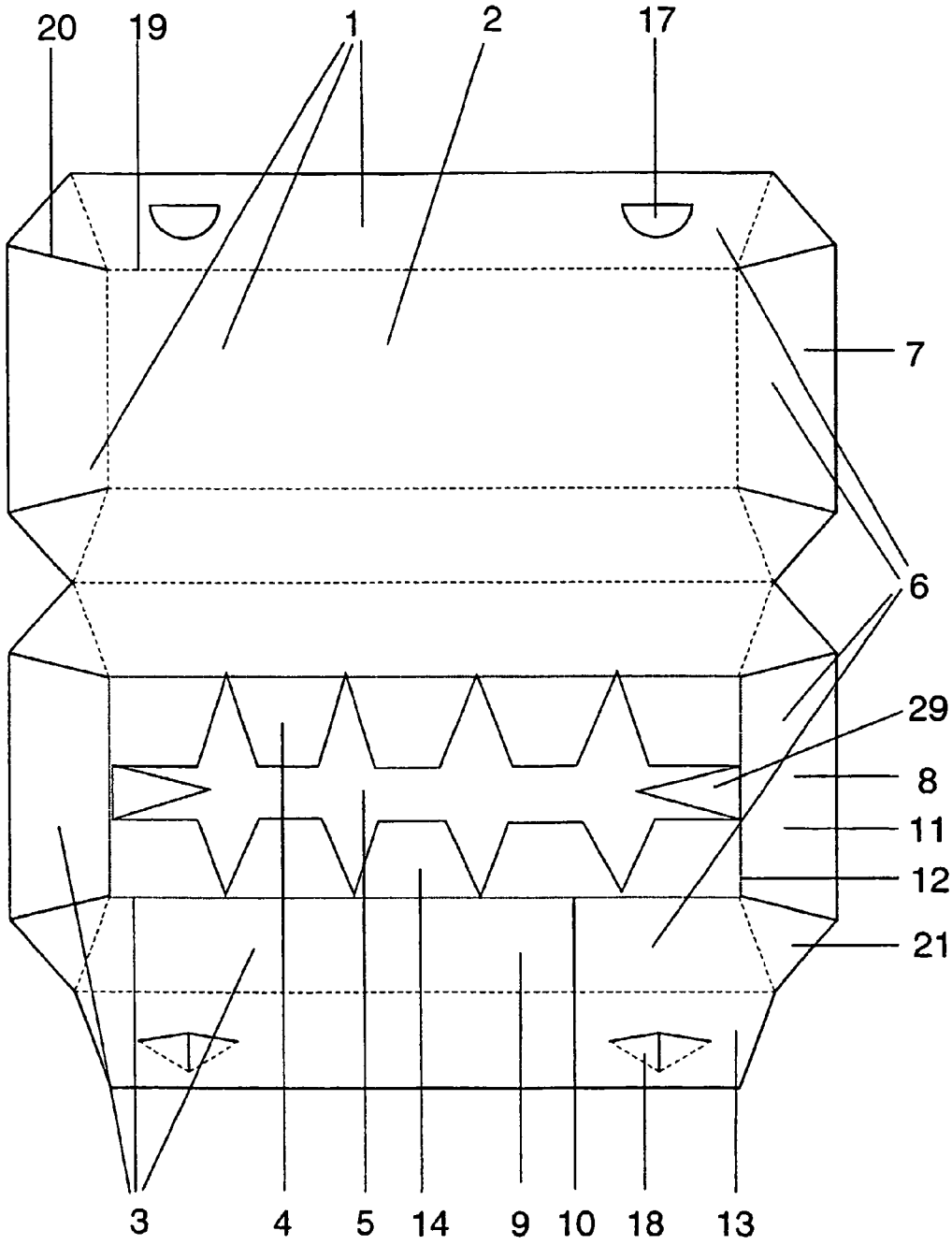
FIG. 1 shows a blank for the cover and the bottom part of an inventive packaging. Folding lines are shown with dotted lines and cut lines are shown with solid lines.
Figure 2:
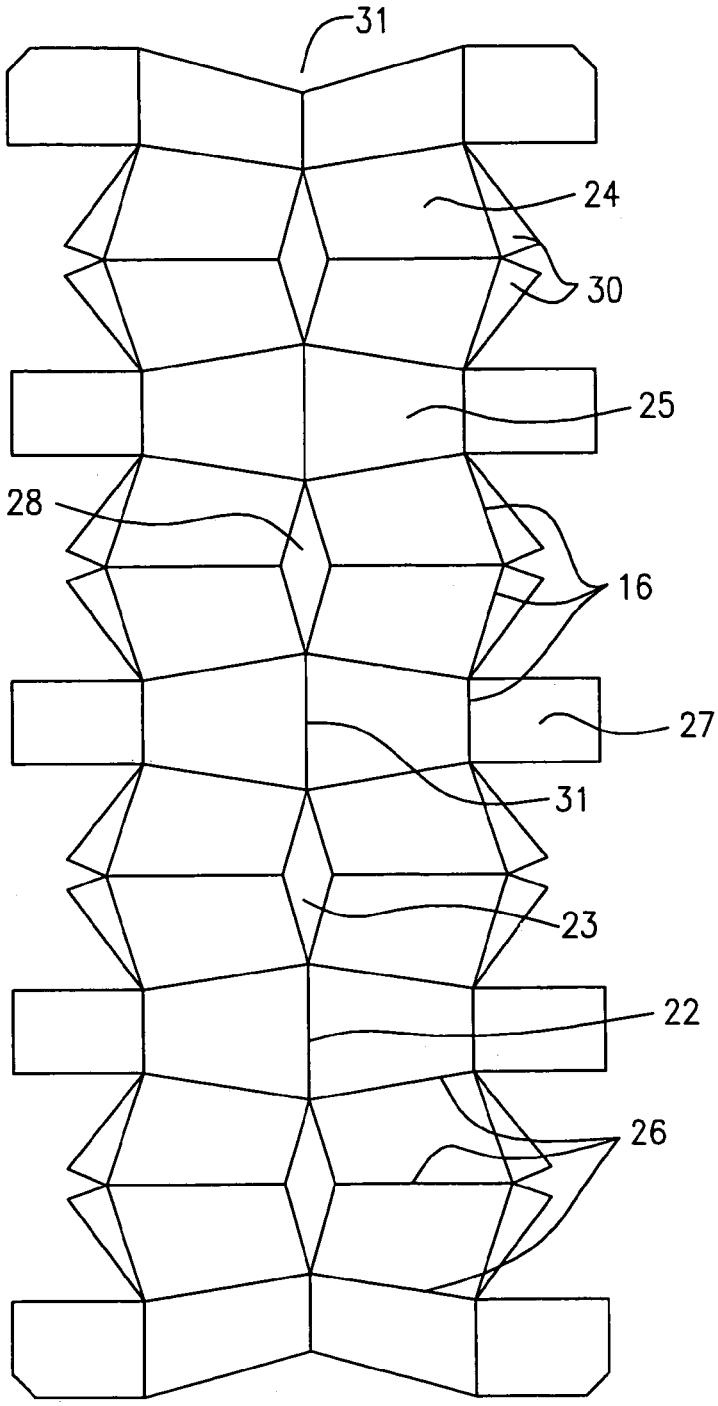
FIG. 2 shows the insert which forms the receptacle cells in the bottom part after being uprighted and locked in position in the packaging according to FIG. 3.
Figure 3:
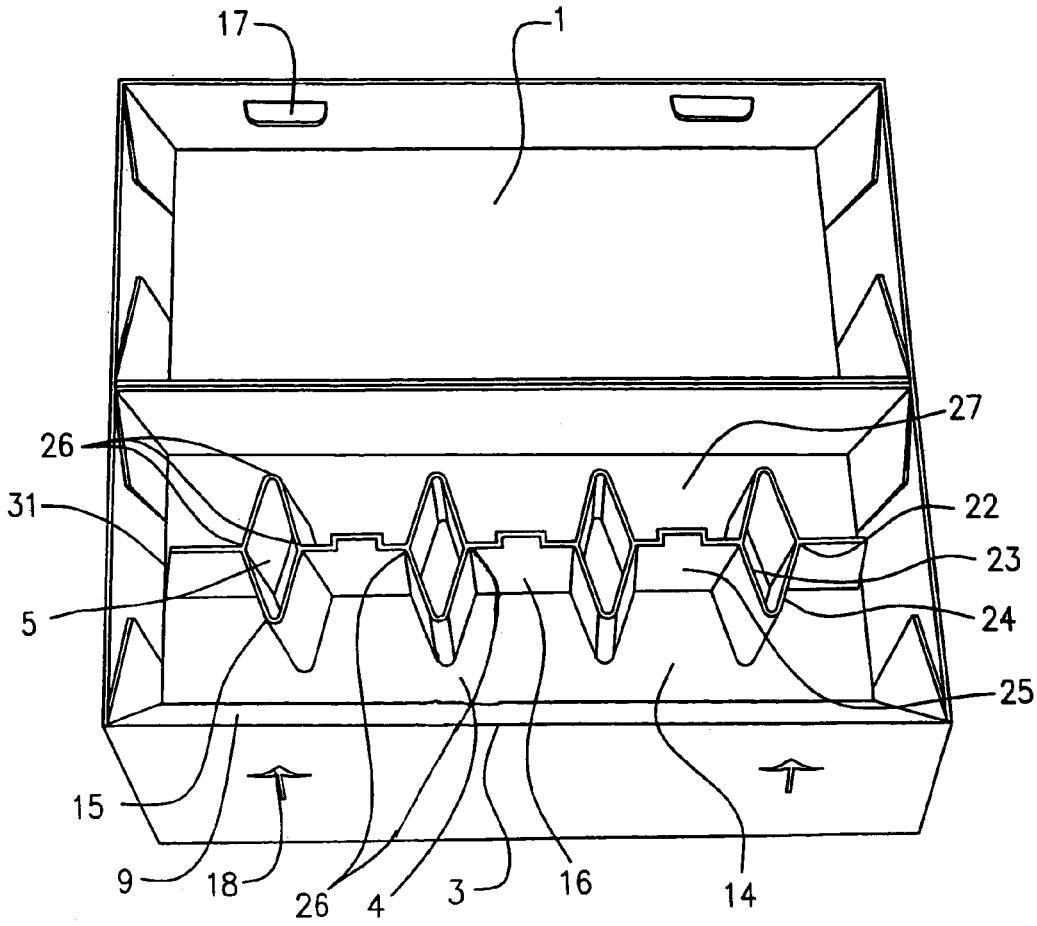
FIG. 3 shows an overall view of a packaging such as that used for packaging ten eggs using the blanks according to FIGS. 1 and 2.
Figure 3:
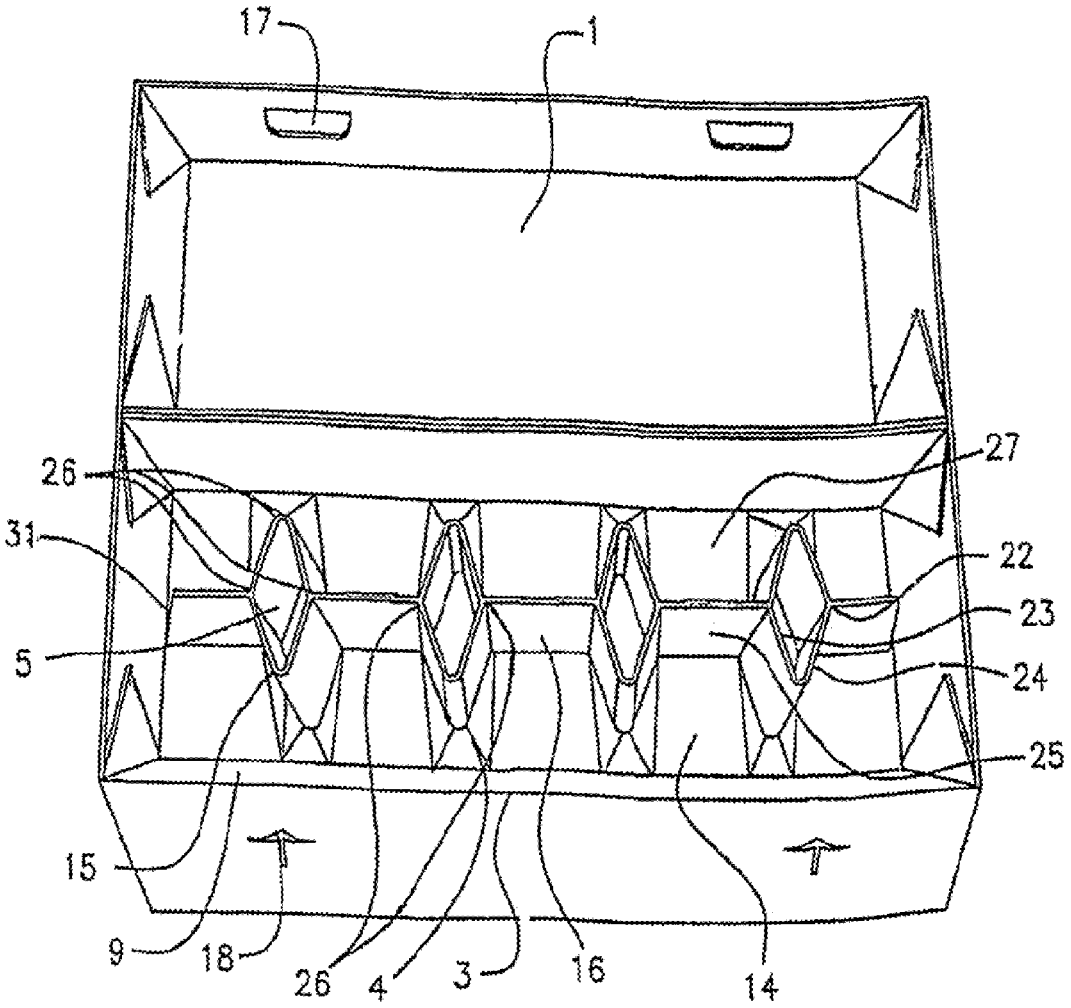

An embodiment according to FIGS. 1 through 3 is described below as an example.

The cover 1, the bottom part 3 and the side walls 6 form the outside surfaces of the packaging. The bottom part 3 has a bottom surface 4 with a polygonal recess and with lower side parts 8. The recess 5 in the bottom part 3 is used to accommodate the insert 15 of a similar second opened package (not shown) which is stacked beneath the first opened package.

The recess 5 runs in the longitudinal direction in an approximately rectangular form, with the longer leg of the recess being aligned in parallel with the longer side wall (longitudinal side wall 9) and the shorter leg being brought up to or just before the shorter side wall (transverse side wall 11) and additional recessed surfaces emanating in a triangular shape from the longer leg of the side wall 8, with the tips of the triangles extending toward longer side wall (longitudinal side wall 9). As an adhesive surface, the remaining inner bottom surface 4 provides a secure hold for the insert 15. Triangular tongues 29 which are used for closing the openings in the transverse ends 32 of the insert are situated at the transverse ends of the recess 5 running in the longitudinal direction in an approximately rectangular form.

The tongues 21 connect the side parts 7 or 8 of the transverse side wall 11 to those of the longitudinal side wall 9 at an angle when set upright at an angle. The tongues are designed to be triangular and have a folded edge with the side part of the longitudinal side wall 9 to which they are connected in an articulated manner.

The side walls 9, 11 are formed by an upper side part 7 and a lower side part 8, with only the rear upper and lower side parts 7, 8 of the longitudinal side wall 9 being joined together by a folded edge so that the cover 1 and the bottom part 3 are joined together in an articulated connection.

The dividing line between the upper side part 7 and the lower side part 8 is longer than the edge which forms the side part 8 and the bottom surface 4 and/or the side part 7 and the cover surface 2. In the upright state, the upper and lower side parts 7, 8 of a side wall 6 are at essentially the same height.

The front lower side part 8 of the longitudinal side wall 9 is connected in an articulated connection by a folded edge to a closing tongue with bulges 18 that are folded outward and are formed by cut edges and folding edges (see for example FIG. 1; in FIG. 3 the closing tongue 13 is part of the cover 1). In closing, the closing tongue is pushed beneath the front upper side part 8 of the longitudinal side wall 9 of the cover, with the bulges 18 engaging in the openings 17 in the front upper side part 7 of the longitudinal side wall 9 of the cover 1 and locking the bottom part 3 and the cover 1.

FIG. 2 shows the flat blank from which middle webs 25 which protrude upward for subdividing the bottom part 3 into two rows of receptacle cells 14 are formed by uprighting. Along the middle webs 25 are formed side webs 26 at the height of the openings by folding them out on both sides of a middle web 25.

The insert has an upper folding edge 22 and at the height of the openings 23 it has three folded lines/folded edges 26 which extend centrally from the ends of the openings 23 to the longitudinal side edge 16 of the flat lying insert, whereby the folded edges 26 extending from the ends of the openings are at a distance from the upper (middle) folded edge 22 to span trapezoidal areas in between. The part of the longitudinal side edges 16, which is part of the tongues 27 of the middle webs 25, forms two lines that are essentially parallel with the upper folding line. The openings 23 are in the shape of diamonds. Between the side walls of the insert, central bordering surfaces of the receptacle cells are spanned by the middle webs 25. At the base of the central bartering surfaces there are bent tongues 27 which form a glued joint with the bottom surface 4 of the bottom part 3. Likewise at the base of the side webs of the insert there are triangular tongues 29 which in the uprighted state rest on the bottom surface 4 of the bottom part 3.

The tongues 27 may also be so long that they abut against the lower longitudinal side walls 9 at the height of the bottom surface 4 and thus help to position the insert 15 with millimeter precision on insertion.

The invention claimed is:

1. A packaging comprising a cover, a bottom part and at least one insert, whereby the cover and the bottom part are made essentially of one or more flat lying blanks, the insert is able to be uprighted from a flat lying blank along an upper fold line which has at least one opening, whereby at least two fold lines extend from each of the openings to each of the two longitudinal side edges so that side webs and middle webs can be folded out to form the receptacle cells when the insert is uprighted, and the bottom part has one or more recesses to accommodate the insert of a second open packaging of the same kind stacked beneath the first open packaging.

2. The packaging according to claim 1, whereby at least three fold lines extend from each of the openings to the longitudinal side edges to fold out side webs when uprighted.

3. The packaging according to claim 1, characterized in that the insert forms an essentially fixed connection with the bottom surface, and the insert extends upward from the bottom panel to the inside of the cover surface.

4. The packaging according to claim 1, characterized in that the cover, the bottom part and one or more side parts can be uprighted from one piece of a flat blank.

5. The packaging according to claim 1, characterized in that the insert can be uprighted from one piece of a flat blank.

6. The packaging according to claim 1, characterized in that the fold lines which extend from the ends of the openings retire from the middle/upper fold edge to span trapezoidal areas in between which form the side webs.

7. The packaging according to claim 1, characterized in that the middle webs span the central bordering surfaces of the receptacle cells.

8. The packaging according to claim 1, characterized in that bent tongues are situated at the base of the side webs and/or at the base of the middle webs which form a glue joint with the bottoms surface of the bottom part.

9. The packaging according to claim 1, characterized in that bent tongues are situated at the base of the middle webs and are designed to be so long that they abut against the lower longitudinal side walls.

10. The packaging according to claim 1, characterized in that the packaging has middle, lower and upper side edges, with the middle side edges being longer than the upper side edges and the lower side edges.

11. The packaging according to claim 1, characterized in that the packaging has upper and lower side parts whereby the upper and lower side parts of a side wall have essentially the same area extents.

12. The packaging according to claim 1, characterized in that the packaging has at least one opening on and/or in an upper and/or lower side wall and a bulge on and/or in the lower and/or upper side wall corresponding to it, whereby opening and bulge fit together when closed and keep the cover closed.

13. The packaging according to claim 1, characterized in that just above the bottom surface the recess has approximately the shape and size of a cutting surface which is aligned horizontally due to the insert (15) being uprighted.

14. A method of uprighting an insert consisting of a flat blank which has an upper fold line with at least one opening, whereby at least two fold lines extend from each opening from the upper fold line to the longitudinal side edges to outfold side webs and middle webs to form receptacle cells in uprighting the insert, and the middle webs have tongues, comprising the following steps:

gripping the tongues of the middle webs with displaceable holders, with each holder forming with each tongue at least one holding point, outfolding the side webs through longitudinal movement of the holding points in the direction of the center of the blank and outfolding the middle webs by transverse movement of the holding points in the direction of the center of the blank.

15. The method according to claim 14, further comprising the following steps:

supporting the outfolding of the side webs and the middle webs through the use of uprighting devices which are movable in the surface normal of the plane of the holding points whereby the uprighting devices act on the blank along a common direction with respect to the surface normal of the plane of the holding points.

16. The method according to claim 15, characterized in that the uprighting devices act on the side web surfaces during the longitudinal movement and/or the transverse movement.

17. The method according to claim 15, characterized in that the uprighting devices are designed as lifting cylinders or as gripper holders.

18. The method according to claim 14, characterized in that first there is the longitudinal movement and then the transverse movement.

19. The method according to claim 14, characterized in that each displaceable holder includes a holding gripper and a movable counter-support for gripping the tongues of the middle webs during the longitudinal and transverse movements.

20. The method according to claim 19, characterized in that the holding grippers are designed as suction cup grippers.

21. The method according to claim 14, characterized in that the holding points all lie in a plane.

22. The method according to claim 14, characterized in that at least three fold lines extend from each of the openings to the longitudinal side edges in order to fold out side webs when uprighting.

23. The method according to claim 14, characterized in that the fold lines extending from the ends of the openings retire from the middle/upper fold edge to span in between the trapezoidal areas forming the side webs.

24. The packaging according to claim 4 wherein all of the side parts can be uprighted from one piece of a flat blank.

25. The packaging according to claim 12 wherein the bulge is formed by cut lines and by folding outward.

26. The method according to claim 16 wherein the uprighting devices act on the side web surfaces during longitudinal movement and/or the transverse movement at the height of the middle fold lines of the side web and/or on the middle web surfaces at the height of the upper fold line of the middle web.

* * * * *

UNITED STATES PATENT AND TRADEMARK OFFICE

CERTIFICATE OF CORRECTION

PATENT NO. : 7,188,727 B2
APPLICATION NO. : 10/487855
DATED : March 13, 2007
INVENTOR(S) : Hartwig Chamier von Gliszczynski It is certified that error appears in the above-identified patent and that said Letters Patent is hereby corrected as shown below:

Replace Figure 3 with Figure 3 attached on a separate sheet hereto.

Signed and Sealed this

First Day of January, 2008

JON W. DUDAS
*Director of the United States Patent and Trademark Office*